US007077276B1

(12) United States Patent
Romano

(10) Patent No.: US 7,077,276 B1
(45) Date of Patent: Jul. 18, 2006

(54) CLOTHES DRYING APPARATUS

(76) Inventor: Kathleen Romano, 6 Golden Ridge Dr., Levittown, PA (US) 19057

( * ) Notice: Subject to any disclaimer, the term of this patent is extended or adjusted under 35 U.S.C. 154(b) by 98 days.

(21) Appl. No.: 10/638,156

(22) Filed: Aug. 8, 2003

(51) Int. Cl.
*A47B 43/00* (2006.01)
*A47B 47/00* (2006.01)

(52) U.S. Cl. ..... 211/196; 211/197; 211/205; 211/118

(58) Field of Classification Search ..... 211/195, 211/196, 197, 180, 113, 118, 119.004, 119.009, 211/85.24, 205; 248/163.1, 164, 165, 166, 248/170
See application file for complete search history.

(56) References Cited

U.S. PATENT DOCUMENTS 1,073,763 A * 9/1913 Kalitzky ..... 211/196
1,176,563 A * 3/1916 Johnson ..... 211/196
1,525,701 A * 2/1925 Rose et al. ..... 211/196
2,769,248 A * 11/1956 Ashworth ..... 34/665
2,923,449 A * 2/1960 Sund ..... 223/69
3,069,021 A * 12/1962 Gray ..... 211/197
3,464,664 A * 9/1969 Nugent ..... 248/435
3,834,548 A * 9/1974 Cliffton et al. ..... 211/118
D261,350 S 10/1981 Koshiyama
4,550,840 A * 11/1985 Van Deursen ..... 211/197
4,895,261 A 1/1990 Yacobian
5,458,249 A 10/1995 Shang-Lu
5,819,961 A 10/1998 Harris

* cited by examiner

*Primary Examiner*—Jennifer E. Novosad

(57) ABSTRACT

A clothes drying apparatus for allowing articles that need to be dried flat to air dry. The clothes drying apparatus includes a support assembly being designed for being selectively positioned on a support surface. A plurality of support frame assemblies are pivotally coupled to the support assembly whereby each of the support frame assemblies selectively radiates from the support assembly. Each of the support frame assemblies is designed for receiving and supporting at least one article of clothing to allow the clothing to air dry.

16 Claims, 3 Drawing Sheets

CLOTHES DRYING APPARATUS

BACKGROUND OF THE INVENTION

1. Field of the Invention

The present invention relates to clothes drying racks and more particularly pertains to a new clothes drying apparatus for allowing articles that need to be dried flat to air dry.

2. Description of the Prior Art

The use of clothes drying racks is known in the prior art. U.S. Pat. No. 5,458,249 describes a device for supporting clothing to allow the clothing to air dry. Another type of clothes drying rack is U.S. Pat. No. 4,895,261 having a plurality of hoops for receiving clothing that is to be suspended from the hoops to allow the clothing to dry. U.S. Pat. No. 5,819,961 has a portable valet for supporting a garment. U.S. Patent No. Des. 261,350 shows a clothes dryer rack.

While these devices fulfill their respective, particular objectives and requirements, the need remains for a device that has certain improved features allowing for clothing articles to be dried flat.

SUMMARY OF THE INVENTION

The present invention meets the needs presented above by providing a support member of each of the support frame assemblies to receive clothing allowing for the clothing to be flat dried.

Still yet another object of the present invention is to provide a new clothes drying apparatus that can be easily stored when not in use.

Even still another object of the present invention is to provide a new clothes drying apparatus that can accommodate items of clothing that can be hung to dry.

To this end, the present invention generally comprises a support assembly being designed for being selectively positioned on a support surface. A plurality of support frame assemblies are pivotally coupled to the support assembly whereby each of the support frame assemblies selectively radiates from the support assembly. Each of the support frame assemblies is designed for receiving and supporting at least one article of clothing to allow the clothing to air dry.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
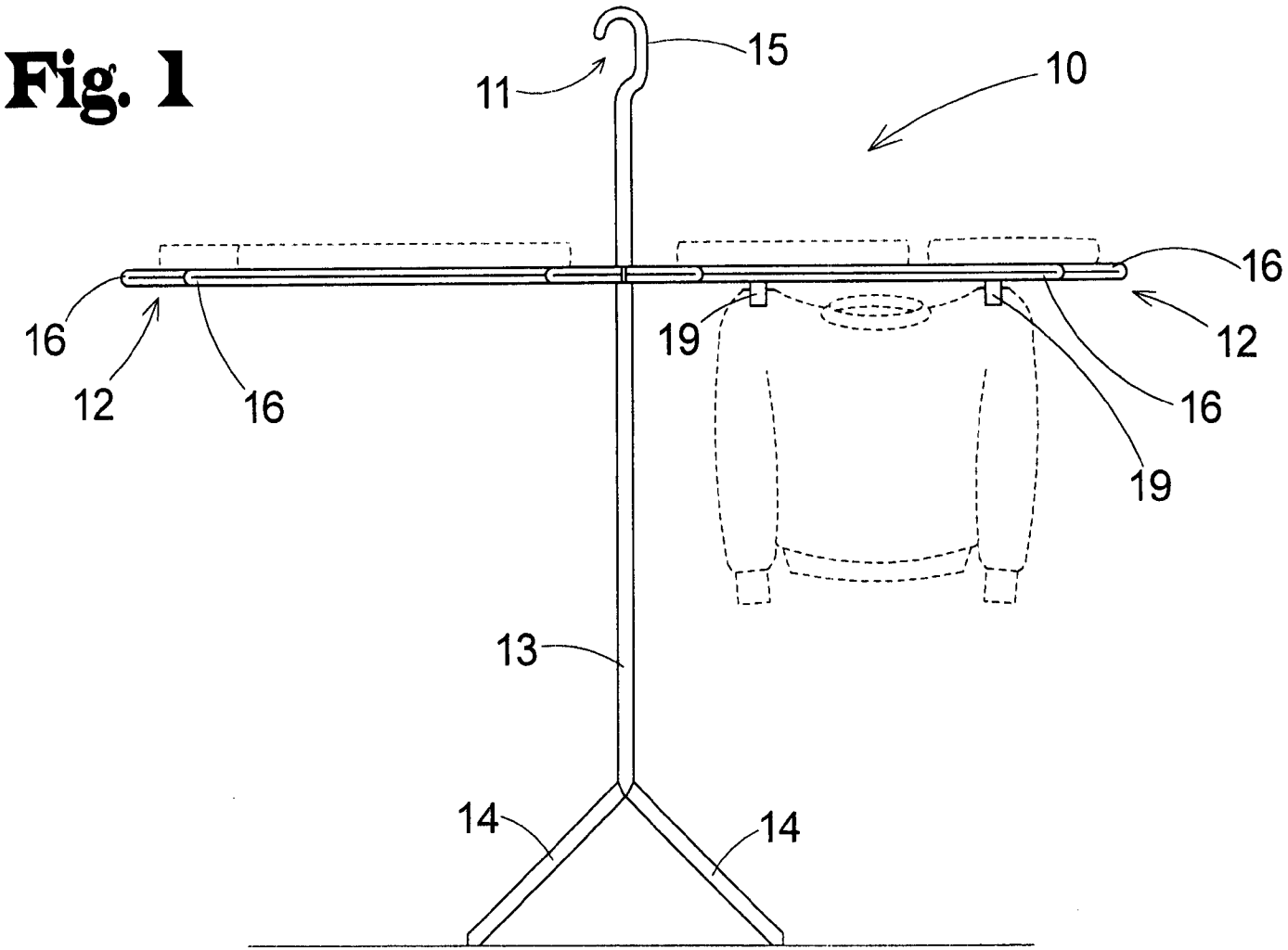
FIG. 1 is a side view of a new clothes drying apparatus according to the present invention.
Figure 2:
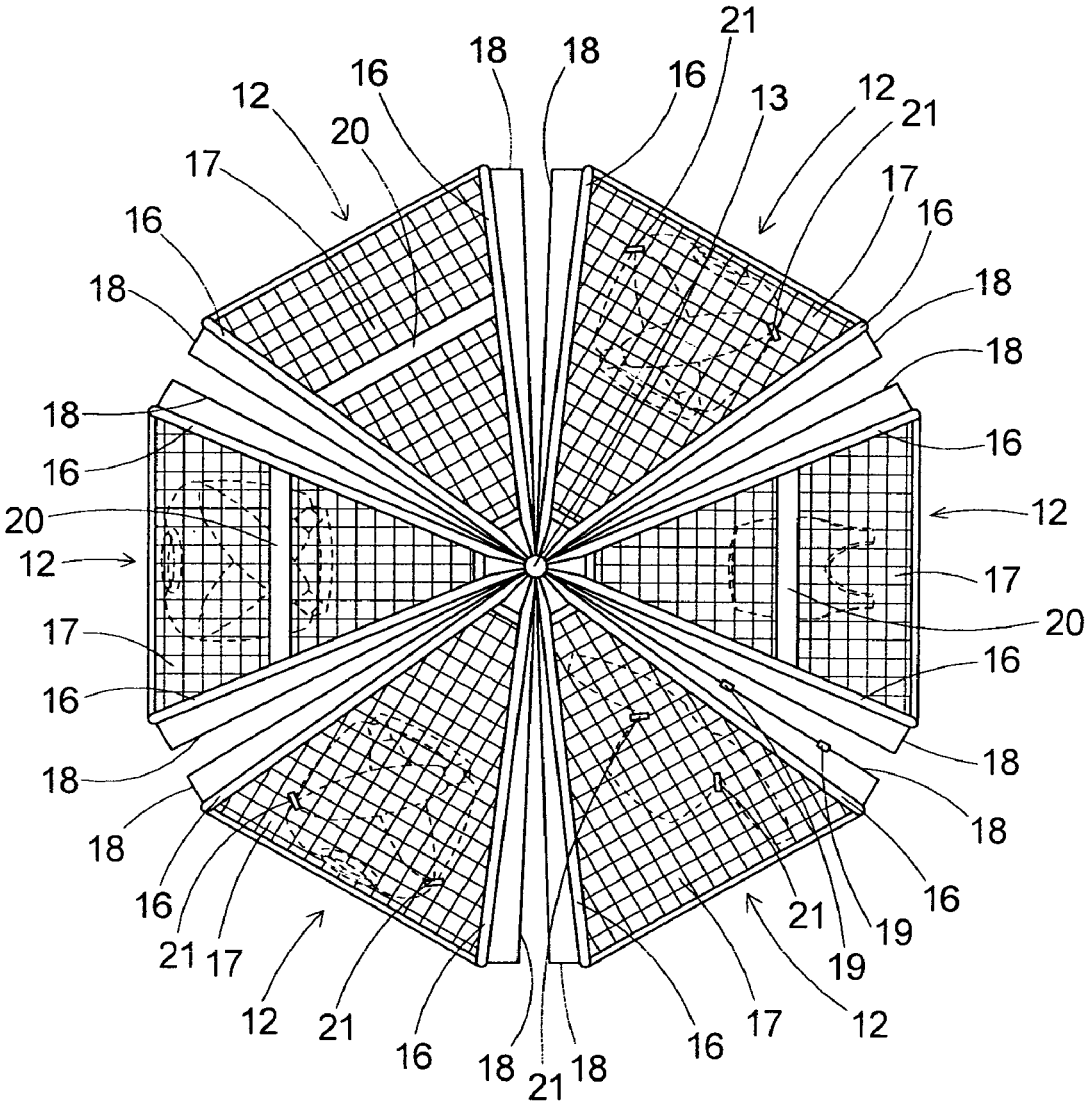
FIG. 2 is a top view of the present invention.
Figure 3:
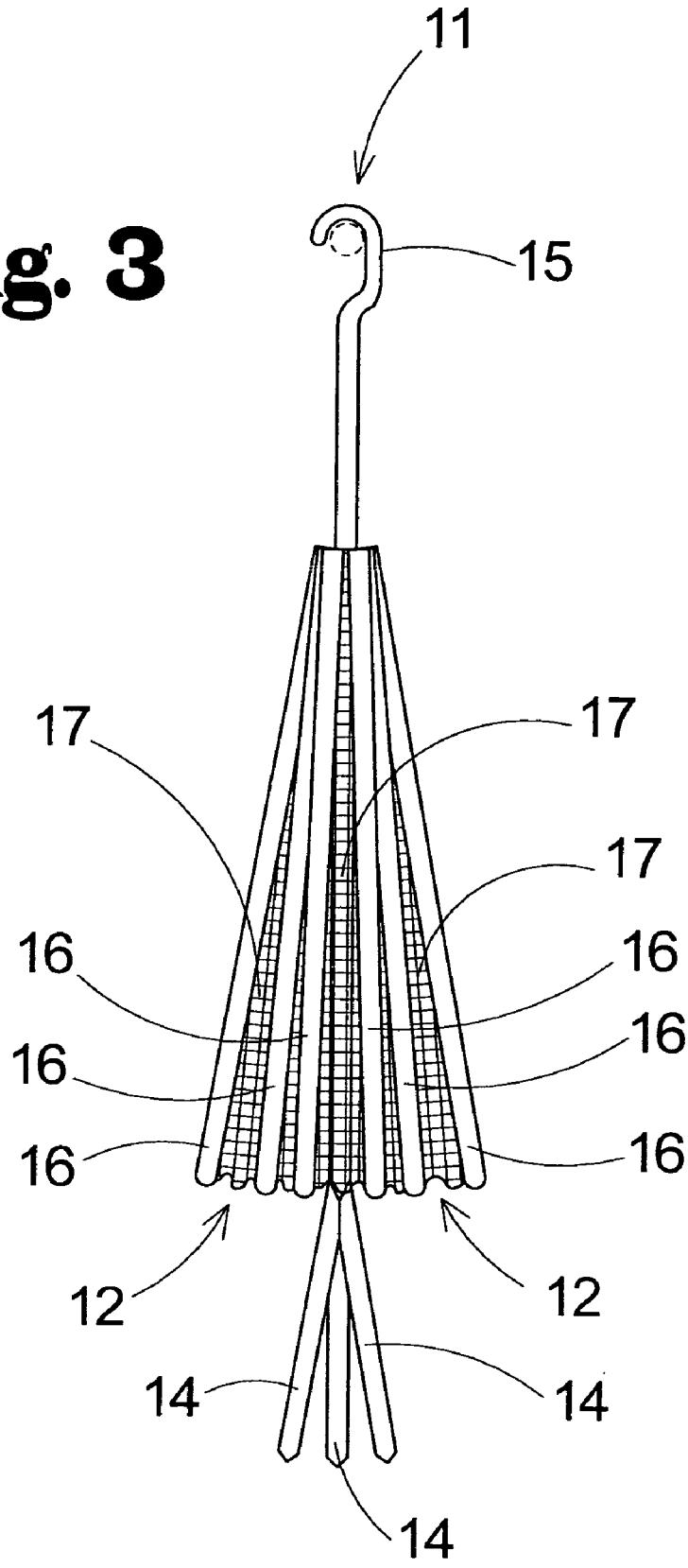
FIG. 3 is a side view of the present invention shown in storage.

With reference now to the drawings, and in particular to FIGS. 1 through 3 thereof, a new clothes drying apparatus embodying the principles and concepts of the present invention and generally designated by the reference numeral 10 will be described.

As best illustrated in FIGS. 1 through 3, the clothes drying apparatus 10 generally comprises a support assembly 11 being designed for being selectively positioned on a support surface.

A plurality of support frame assemblies 12 are pivotally coupled to the support assembly 11 whereby each of the support frame assemblies 12 selectively radiates from the support assembly 11. Each of the support frame assemblies 12 is designed for receiving and supporting at least one article of clothing to allow the clothing to air dry.

The support assembly 11 comprises a stanchion member 13. The stanchion member 13 is designed for being positioned on the support surface. Each of the support frame assemblies 12 is pivotally coupled to the stanchion member 13 whereby each of the support frame assemblies 12 is designed for supporting the clothing when the support frame assemblies 12 are pivoted to radially extend from the stanchion member 13.

The support assembly 11 comprises a plurality of base members 14. Each of the base members 14 is pivotally coupled to the stanchion member 13. Each of the base members 14 is designed for being positioned between the stanchion member 13 and the support surface whereby the base members 14 are for stabilizing the stanchion member 13 on the support surface when the support frame assemblies 12 are being used. Each of the base members 14 pivot between a deployed position and a stored position. The stored position of each of the base members 14 is defined by each of the base members 14 being positioned substantially parallel to the stanchion member 13. The deployed position of each of the base members 14 is defined by each of the base members 14 extending at an angle between the stanchion member 13 and the support surface to provide maximum stability for the stanchion member 13.

The support assembly 11 comprises a hook member 15. The hook member 15 is coupled to the stanchion member 13 whereby the hook member 15 is designed for being positioned opposite the support surface when the stanchion member 13 is positioned on the support surface. The hook member 15 is designed for engaging a closet rod to facilitate storage of the support assembly 11 and the support frame assemblies 12 when the support assembly 11 and the support frame assemblies 12 are not in use.

Each of the support frame assemblies 12 comprises pair of frame members 16. Each of the frame members 16 is pivotally coupled to the support assembly 11 whereby each of the frame members 16 is pivotal between a collapsed position and an extended position. The collapsed position of each of the frame members 16 is defined by the associated one of the frame members 16 being positioned substantially parallel to the support assembly 11. The extended position of each of the frame members 16 is defined by the associated one of the frame members 16 radially extending from the support assembly 11. The frame members 16 of each of the support frame assemblies 12 is designed for supporting the weight of the clothing on the associated one of the support frame assemblies 12.

Each of the support frame assemblies 12 comprises a support member 17. The support member 17 is coupled to the frame members 16 of the associated one of the support frame assemblies 12 whereby the support member 17 extends between the frame members 16. The support member 17 is stretched between the frame members 16 of the associated one of the support frame assemblies 12 whereby the support member 17 is designed for supporting clothing in a horizontal state to dry when the frame members 16 are in the extended position. The support member 17 comprises a mesh material. The mesh material is designed for permitting air to pass through the mesh material whereby the mesh material is for permitting air to contact the clothing supported by the support member 17 to facilitate air drying of the clothing.

Each of the support frame assemblies 12 comprises at least one line member 18. The line member 18 is coupled to at least one of the frame members 16 of the associated one of the support frame assemblies 12. The line member 18 is designed for receiving the clothing to allow the clothing to be suspended from the associated one of the support frame assemblies 12 to allow the clothing to dry.

At least one of the support frame assemblies 12 comprises a plurality of clip members 19. Each of the clip members 19 is coupled to the line member 18 of the associated one of the support frame assemblies 12. Each of the clip members 19 selectively engaging the clothing to facilitate suspending the clothing from the line member 18.

Each of the support frame assemblies 12 comprises at least one band member 20. The band member 20 is coupled to the frame members 16 of the associated one of the support frame assemblies 12 whereby the band member 20 extends between the frame members 16, The band member 20 is designed for selectively securing the clothing to the support member 17 of the associated one of the support frame assemblies 12 to inhibit the clothing from blowing away.

Alternately, each of the support frame assemblies 12 comprises at least one securing member 21. The securing member 21 is selectively coupled to the support member 17 of the associated one of the support frame assemblies 12. The securing member 21 is designed for selectively securing the clothing to the support member 17 of the associated one of the support frame assemblies 12 to inhibit the clothing from blowing away.

In use, the user removes the hook member 15 from the closet rod and positions the support assembly 11 in a desired location. The base members 14 are then pivoted into the deployed position and the base members 14 positioned on the support surface. The user then pivots the frame members 16 of each of the support frame assemblies 12 to the extended position. The user can then place clothing on the support member 17 of each of the support frame assemblies 12 to allow the clothing to dry flat. The user may also hang clothing over the line member 18 of each of the support frame assemblies 12 or use the clip members 19 to secure the clothing to the line member 18 to allow the clothing to dry suspended from the associated one of the support frame assemblies 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clothes drying apparatus for supporting wet clothing while the clothing is drying, the clothes drying apparatus comprising:

a support assembly being adapted for being selectively positioned on a support surface;

a plurality of support frame assemblies being pivotally coupled to said support assembly such that each of said support frame assemblies selectively radiates from said support assembly, each of said support frame assemblies being adapted for receiving and supporting at least one article of clothing to allow the clothing to air dry;

wherein adjacent support frame assemblies of the plurality of support frame assemblies are spaced from each other to form radially-extending spaces between the adjacent support frame assemblies;

each of said support frame assemblies comprising a pair of frame members, each of said frame members is pivotally coupled to said support assembly such that each of said frame members is pivotal between a collapsed position and an extended position, said collapsed position of each of said frame members being defined by the associated one of said frame members being positioned substantially parallel to said support assembly, said extended position of each of said frame members being defined by the associated one of said frame members radially extending from said support assembly, said frame members of each of said support frame assemblies being adapted for supporting the weight of the clothing on the associated one of said support frame assemblies; and each of said support frame assemblies comprising a support member, said support member being coupled to said frame members of the associated one of said support frame assemblies such that said support member extends between said frame members, said support member being stretched between said frame members of the associated one of said support frame assemblies such that said support member is adapted for supporting clothing in a horizontal state to dry when said frame members are in said extended position.

2. The clothes drying apparatus as set forth in claim 1, further comprising;

said support assembly comprising a stanchion member, said stanchion member being adapted for being positioned on the support surface, each of said support frame assemblies being pivotally coupled to said stanchion member such that each of said support frame assemblies is adapted for supporting the clothing when said support frame assemblies are pivoted to radially extend from said stanchion member.

3. The clothes drying apparatus as set forth in claim 2, further comprising:

said support assembly comprising a plurality of base members, each of said base members being pivotally coupled to said stanchion member, each of said base members is adapted for being positioned between said stanchion member and the support surface such that said base members are for stabilizing the stanchion member on the support surface when said support frame assemblies are being used, each of said base members pivot between a deployed position and a stored position, said stored position of each of said base members being defined by each of said base members being positioned substantially parallel to said stanchion member, said deployed position of each of said base members being defined by each of said base members extending at an angle between said stanchion member and the support surface to form a tripod configuration to provide maximum stability for said stanchion member.

4. The clothes drying apparatus as set forth in claim 2, further comprising:

said support assembly comprising a hook member, said hook member being coupled to said stanchion member such that said hook member is adapted for being positioned opposite the support surface when said stanchion member is positioned on the support surface, said hook member being adapted for engaging a closet rod to facilitate storage of said support assembly and said support frame assemblies when said support assembly and said support frame assemblies are not in use.

5. The clothes drying apparatus as set forth in claim 1, further comprising:

said support member comprising a mesh material stretched between said frame members, said mesh material being adapted for permitting air to pass through said mesh material such that said mesh material is for permitting air to contact the clothing supported by said support member to facilitate air drying of the clothing.

6. The clothes drying apparatus as set forth in claim 1, further comprising:

each of said support frame assemblies comprising at least one line member, said line member being coupled to at least one of said frame members of the associated one of said support frame assemblies, said line member being adapted for receiving the clothing to allow the clothing to be suspended from the associated one of said support frame assemblies to allow the clothing to dry.

7. The clothes drying apparatus as set forth in claim 6, further comprising:

at least one of said support frame assemblies comprising a plurality of clip members, each of said clip members being coupled to said line member of the associated one of said support frame assemblies, each of said clip members selectively engaging the clothing to facilitate suspending the clothing from said line member.

8. The clothes drying apparatus as set forth in claim 1, further comprising:

each of said support frame assemblies comprising at least one band member, said band member being coupled to said frame members of the associated one of said support frame assemblies such that said band member extends between said frame members, said band member being adapted for selectively securing the clothing to said support member of the associated one of said support frame assemblies to inhibit the clothing from blowing away.

9. The clothes drying apparatus as set forth in claim 1, further comprising:

each of said support frame assemblies comprising at least one securing member, said securing member being selectively coupled to said support member of the associated one of said support frame assemblies, said securing member being adapted for selectively securing the clothing to said support member of the associated one of said support frame assemblies to inhibit the clothing from blowing away.

10. The clothes drying apparatus as set forth in claim 1, wherein each of said support frame assemblies comprises at least one line member positioned in said radially-extending spaces between the adjacent support frame assemblies.

11. The clothes drying apparatus as set forth in claim 10, wherein said at least one line member is coupled to one of said frame members and extends from said frame member into said radially-extending space such that a medial section of said line member is spaced from said frame member.

12. The clothes drying apparatus as set forth in claim 10, wherein a pair of said at least one line members is positioned in each of said radially-extending spaces, each line member of said pair of line members being associated with one of said adjacent support frame assemblies.

13. The clothes drying apparatus as set forth in claim 1 wherein each of said support frame assemblies has a substantially triangular perimeter, and each of said radially-extending spaces between said adjacent support frame assemblies is substantially triangular.

14. A clothes drying apparatus for supporting wet clothing while the clothing is drying, the clothes drying apparatus comprising:

a support assembly being adapted for being selectively positioned on a support surface;

a plurality of support frame assemblies being pivotally coupled to said support assembly such that each of said support frame assemblies selectively radiates from said support assembly, each of said support frame assemblies being adapted for receiving and supporting at least one article of clothing to allow the clothing to air dry;

adjacent ones of said support frame assemblies of the plurality of support frame assemblies being spaced from each other to form radially-extending spaces between each pair of of said adjacent support frame assemblies;

said support assembly comprising a stanchion member, said stanchion member being adapted for being positioned on the support surface, each of said support frame assemblies being pivotally coupled to said stanchion member such that each of said support frame assemblies is adapted for supporting the clothing when said support frame assemblies are pivoted to radially extend from said stanchion member;

said support assembly comprising a plurality of base members, each of said base members being pivotally coupled to said stanchion member, each of said base members is adapted for being positioned between said stanchion member and the support surface such that said base members are for stabilizing the stanchion member on the support surface when said support frame assemblies are being used, each of said base members pivot between a deployed position and a stored position, said stored position of each of said base members being defined by each of said base members being positioned substantially parallel to said stanchion member, said deployed position of each of said base members being defined by each of said base members extending at an angle between said stanchion member and the support surface to provide maximum stability for said stanchion member;

said support assembly comprising a hook member, said hook member being coupled to said stanchion member such that said hook member is adapted for being positioned opposite the support surface when said stanchion member is positioned on the support surface, said hook member being adapted for engaging a closet rod to facilitate storage of said support assembly and said support frame assemblies when said support assembly and said support frame assemblies are not in use;

each of said support frame assemblies comprising a pair of frame members, each of said frame members is pivotally coupled to said support assembly such that each of said frame members is pivotal between a collapsed position and an extended position, said collapsed position of each of said frame members being defined by the associated one of said frame members being positioned substantially parallel to said support assembly, said extended position of each of said frame members being defined by the associated one of said frame members radially extending from said support assembly, said frame members of each of said support frame assemblies being adapted for supporting the weight of the clothing on the associated one of said support frame assemblies;

each of said support frame assemblies comprising a support member, said support member being coupled to said frame members of the associated one of said support frame assemblies such that said support member extends between said frame members, said support member being stretched between said frame members of the associated one of said support frame assemblies such that said support member is adapted for supporting clothing in a horizontal state to dry when said frame members are in said extended position;

said support member comprising a mesh material, said mesh material being adapted for permitting air to pass through said mesh material such that said mesh material is for permitting air to contact the clothing supported by said support member to facilitate air drying of the clothing;

each of said support frame assemblies comprising at least one line member positioned in said radially-extending spaces between the adjacent support frame assemblies, said at least line member being coupled to one of said frame members of said support frame assembly and extending from said frame member into said radially-extending space;

at least one of said support frame assemblies comprising a plurality of clip members, each of said clip members being coupled to said line member of the associated one of said support frame assemblies, each of said clip members selectively engaging the clothing to facilitate suspending the clothing from said line member.

15. The clothes drying apparatus as set forth in claim 14, further comprising:

each of said support frame assemblies comprising at least one band member, said band member being coupled to said frame members of the associated one of said support frame assemblies such that said band member extends between said frame members, said band member being adapted for selectively securing the clothing to said support member of the associated one of said support frame assemblies to inhibit the clothing from blowing away.

16. The clothes drying apparatus as set forth in claim 14, further comprising;

each of said support frame assemblies comprising at least one securing member, said securing member being selectively coupled to said support member of the associated one of said support frame assemblies, said securing member being adapted for selectively securing the clothing to said support member of the associated one of said support frame assemblies to inhibit the clothing from blowing away.

* * * * *